US007060106B2

(12) United States Patent
Kleker

(10) Patent No.: US 7,060,106 B2
(45) Date of Patent: Jun. 13, 2006

(54) APPARATUS FOR WASHING AND DRYING GARMENTS

(76) Inventor: Richard George Kleker, 98 Price La., Pleasant Hill, CA (US) 94523

( * ) Notice: Subject to any disclaimer, the term of this patent is extended or adjusted under 35 U.S.C. 154(b) by 70 days.

(21) Appl. No.: 10/417,045

(22) Filed: Apr. 15, 2003

(65) Prior Publication Data

US 2004/0206131 A1 Oct. 21, 2004

(51) Int. Cl.
*D06F 18/00* (2006.01)
*D06F 37/00* (2006.01)

(52) U.S. Cl. ..... 8/149.1; 68/5 C; 68/205 R

(58) Field of Classification Search ..... 8/149.1, 8/149.2, 149.3; 68/5 A, 5 B, 5 C, 5 R, 20, 68/205 R; 134/172, 174, 199; 34/643–644
See application file for complete search history.

(56) References Cited

U.S. PATENT DOCUMENTS

| | | | | |
|---|---|---|---|---|
| 2,741,113 A | | 4/1956 | Norkus | |
| 2,845,786 A | | 9/1958 | Chrisman | |
| 3,102,796 A | | 9/1963 | Erickson | |
| 3,114,919 A | | 12/1963 | Kenrich | |
| 3,166,923 A | | 1/1965 | Zacks | |
| 3,257,739 A | | 6/1966 | Wentz | |
| 3,664,159 A | | 5/1972 | Mazza | |
| 3,672,188 A | | 6/1972 | Geschka et al. | |
| 3,683,651 A | | 8/1972 | Mazza | |
| 3,707,855 A | | 1/1973 | Buckley | |
| 3,732,628 A | | 5/1973 | Blevens et al. | |
| 3,739,496 A | | 6/1973 | Buckley et al. | |
| 3,768,283 A | * | 10/1973 | Bold et al. | 68/205 R |
| 3,827,262 A | * | 8/1974 | Manuel | 68/3 R |
| 3,868,835 A | * | 3/1975 | Todd-Reeve | 68/20 |
| 3,927,539 A | * | 12/1975 | Harkison | 68/3 R |
| 4,207,683 A | | 6/1980 | Horton | |
| 4,391,602 A | | 7/1983 | Stichnoth et al. | |
| 4,646,769 A | * | 3/1987 | O'Brien et al. | 134/199 |
| 4,761,305 A | | 8/1988 | Ochiai | |
| 4,784,666 A | | 11/1988 | Brenner et al. | |
| 5,092,141 A | | 3/1992 | Quinn | |
| 5,226,203 A | | 7/1993 | Sacconato et al. | |
| 5,228,211 A | | 7/1993 | Stubbing | |
| 5,305,484 A | * | 4/1994 | Fitzpatrick et al. | 8/149.3 |
| 5,516,012 A | | 5/1996 | Weigel | |
| 5,730,006 A | | 3/1998 | Conley | |

(Continued)

FOREIGN PATENT DOCUMENTS

WO WO 2052087 A1 * 7/2002

(Continued)

OTHER PUBLICATIONS

New York Magazine, Nov. 17, 2003, 2 pages, advertisement for The Maytag Neptune Drying Center.

*Primary Examiner*—Joseph L. Perrin

(57) ABSTRACT

A device for washing and drying garments or other items in a single unit. The garments or other items are placed in the device on hangers leaving space in between each item. A manifold with arms extends on each side of the items. The manifold moves up and down so that the arms move up and down the length of the items to be treated. The arms have one set of pipes that spray wash water, rinse waters, and other washing liquids on the items. The arms have another set of pipes that carry air to the items, drying the items. After the cycle is complete, the clothes or other items may be left in the device until needed.

21 Claims, 3 Drawing Sheets

U.S. PATENT DOCUMENTS

| | | | | |
|---|---|---|---|---|
| 5,784,905 | A | 7/1998 | Townsend et al. | |
| 5,815,961 | A | 10/1998 | Estes et al. | |
| 5,836,486 | A | 11/1998 | Ohsugi | |
| 5,887,454 | A | 3/1999 | Renzacci | |
| 5,970,554 | A | 10/1999 | Shore et al. | |
| 6,142,010 | A * | 11/2000 | Merck et al. | 73/81 |
| 6,189,346 | B1 | 2/2001 | Chen et al. | |
| 6,425,192 | B1 | 7/2002 | Arrieta et al. | |
| 6,434,803 | B1 | 8/2002 | Spong | |
| 6,568,545 | B1 | 5/2003 | Feder | |
| 6,584,633 | B1 | 7/2003 | Chute et al. | |
| 2003/0233766 | A1 * | 12/2003 | Bolduan et al. | 34/335 |
| 2004/0000174 | A1 * | 1/2004 | Bolduan et al. | 68/5 D |
| 2004/0000175 | A1 * | 1/2004 | Bolduan et al. | 68/5 D |
| 2004/0112095 | A1 * | 6/2004 | Bolduan et al. | 68/5 C |

FOREIGN PATENT DOCUMENTS

| | | | |
|---|---|---|---|
| WO | WO 2052088 | A1 * | 7/2002 |
| WO | WO 2052089 | A1 * | 7/2002 |
| WO | WO 2052093 | A1 * | 7/2002 |

* cited by examiner

APPARATUS FOR WASHING AND DRYING GARMENTS

CROSS REFERENCE TO RELATED APPLICATIONS

Not Applicable.

FEDERAL SPONSORSHIP

Not Applicable.

BACKGROUND

A variety of machines in which clothes may be hung and processed in a single unit have been proposed. There are a series of patents that require the use of solvents for dry cleaning garments, for example U.S. Pat. No. 2,845,786, issued to E. L. Chrisman on Aug. 5, 1958; U.S. Pat. No. 3,166,923 issued to Zacks on Jan. 26, 1965; and U.S. Pat. No. 2,741,113, issued to Norkus on Apr. 10, 1056. The use of solvents, especially in the home, can create health and safety issues.

There are additional patents that claim a machine in which the clothes are "finished" only. These patents are directed toward de-wrinkling and smoothing the clothes, typically by using steam. However, these machines do not clean the clothes, these machines are used after the clothes are already clean. Some examples of these devices are seen in U.S. Pat. No. 3,707,855 issued to Buckley on Jan. 2, 1973; U.S. Pat. No. 4,391,602 issued to Stichnoth et al. on Jul. 5, 1983; U.S. Pat. No. 3,739,496 issued to Buckly et al. on Jun. 19, 1973; U.S. Pat. No. 3,732,628 issued to Bleven et al. on May 15, 1973; and U.S. Pat. No. 4,761,305 issued to Ochiai on Aug. 2, 1988. U.S. Pat. No. 6,189,346 issued to Chen et al. on Feb. 20, 2001 discloses a clothes treating apparatus that uses a "conditioning mist" as an alternative to dry-cleaning clothes. This patent does not provide for washing clothes with water or rinsing the clothes.

In addition, some patents claim machines that only dry clothes, and do not wash or finish the clothes: for example U.S. Pat. No. 3,257,739 issued to Wentz on Jun. 28, 1966; and U.S. Pat. No. 3,102,796 issued to Erickson on Sep. 3, 1963.

U.S. Pat. No. 3,114,919 issued to Kenreich on Dec. 24, 1963 discloses a machine that can wash and dry using conventional laundry soap, however, this apparatus can only wash one shirt, or the like, and one pair of pants, or the like, at a time. In addition, this patent discloses an apparatus that has fixed outlets for dispensing wash and rinse water. This patent, like U.S. Pat. No. 3,664,159 issued to Mazza on May 23, 1972, utilizes a shaking of the garments to remove dirt and debris from the garments. However, shaking the garments can cause the garments to fall during the washing cycle, and can impart wrinkles to the garments. In addition, these patents teach that the wash water is applied from the top and bottom of the clothing, and not along the length of the clothing.

Finally, U.S. Pat. No. 3,672,188 issued to Geschka et al. on Jun. 27, 1972 discloses an apparatus that uses conventional laundry soap water, and hot air to wash and dry clothes. However, in this patent the soap and water are applied to the garments from top and bottom nozzles. Likewise, in U.S. Pat. No. 3,868,835 issued to Todd-Reeve on Mar. 4, 1975, the water and soap are applied from nozzles located near the top and bottom of the apparatus. In neither of these apparatuses is the soap and water applied over the entire length of the garments at close range.

SUMMARY OF THE INVENTION

The invention is generally designed to wash and dry garments or other items in a single machine. The invention is for use in residences or in hotel rooms, hospitals, laundromates, and other commercial applications. In a conventional clothes washing machine it is best to transfer the clothes soon after they are washed to the dryer in order to prevent wrinkling. In addition, it is even more important to rapidly remove dried clothes from the dryer shortly after completion of the drying process to further prevent wrinkling. When using the invention, there is no need to rapidly move clothes from the washing machine to the dryer, or to rapidly remove clothes from the dryer. The clothes are washed and dried on hangers in a single machine. Once the cycle is complete, the clothes may remain in the invention indefinitely, until ready to be worn, suspended from the hangers.

The device is used by placing garments on conventional hangers, and hanging the garments on bar within the machine cabinet. The inventor prefers to use plastic hangers, however any hanger that will support the garments without imparting stains to the wet garments may be used. A manifold supplies wash water, rinse water, and finally air to the garments. The manifold contains a series of arms. A respective pair of the series of arms is disposed on each side of a garment suspended therebetween. Each pair of arms contains orifices, such as nozzles, configured to direct fluids, such as water and air, at a downward angle on both sides of the garment disposed therebetween. The manifold, arms, and nozzles contain a dual internal system of pipes. One set of internal pipes allows wash water and rinse water to be directed toward the garments. The other set of internal pipes allows air to be directed toward the garments.

During operation, the wash water containing soap travels up the first set of internal pipes in the manifold, through the arms, out the nozzles, and onto the clothes. The entire manifold traverses up and down the length of the hanging clothes, spraying the clothes with soapy water.

After the wash cycle is complete, rinse water travels through the same first set of internal pipes in the manifold, and arms, and out the same nozzle. The manifold again traverses up and down the length of the hanging clothes, spraying the clothes with rinse water.

In the drying cycle, hot or cool air travels through the second set of internal pipes in the manifold, through the arms, and out a separate set of nozzles and toward the garments. The air may exit the apparatus through vents, or may be re-circulated through a condenser. The condenser will remove the moisture from the air and direct the air toward the garments.

The duration of the washing cycle, rinse cycle, and drying cycle is controlled through a control panel.

When the clothes washing and drying cycle is complete the clothes may remain in the machine until such time as is convenient to remove the clothes.

DESCRIPTION OF THE INVENTION

Figure 1:
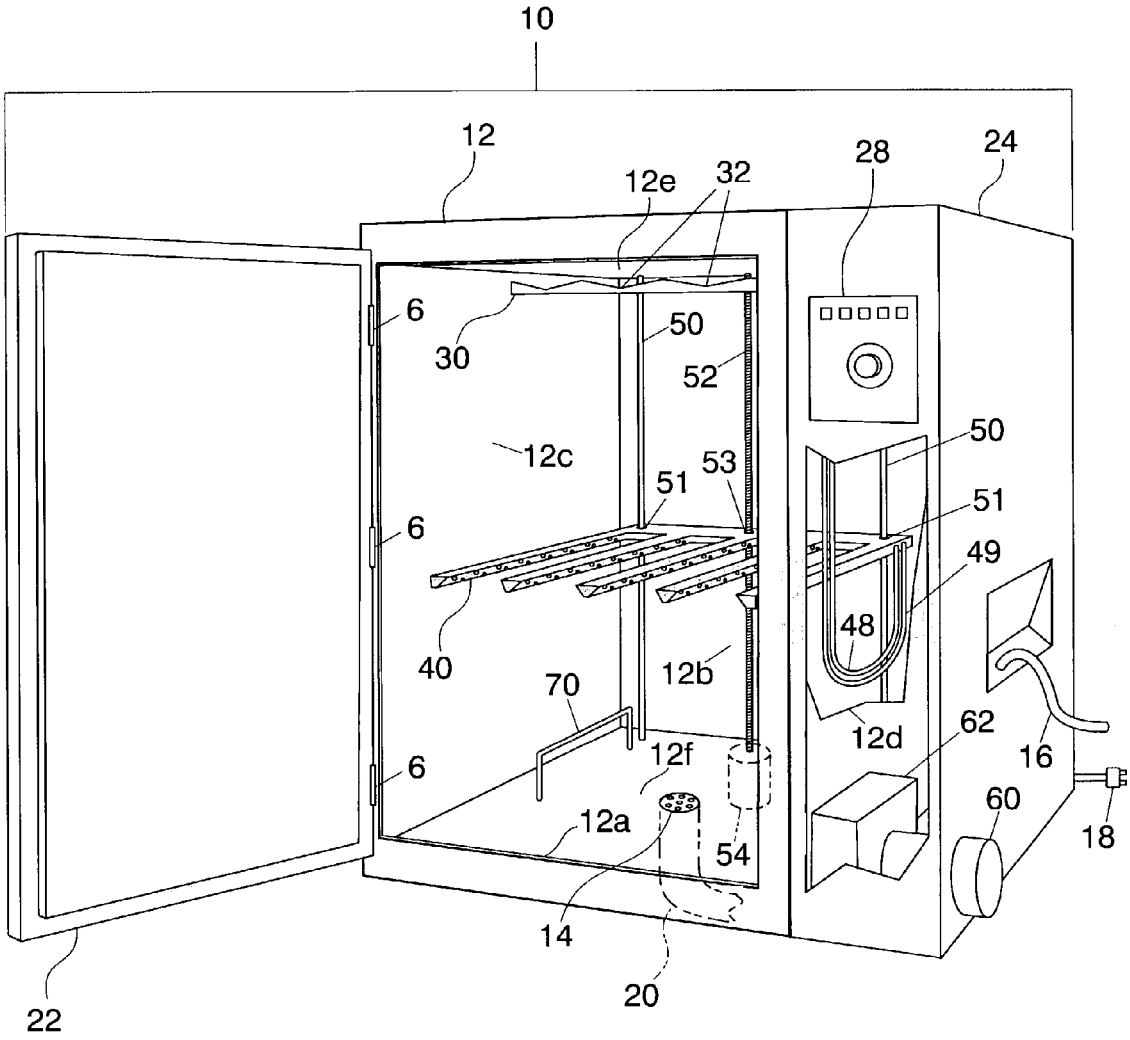
FIG. 1 is a perspective view, and shows the device from the front with the door open, and a cut-away section to see inside the sub-cabinet.

Apparatus 10 comprises a cabinet 12 with front wall 12*a*, rear wall 12*b*, two side walls 12*c* and 12*d*, and a top and bottom wall 12*e* and 12*f*. In the preferred embodiment said walls of cabinet 12 are insulated. Apparatus 10, like conventional washers and dryers, is connected to a water supply by hose 16, to an electrical supply by conductors 18, and to a drain by hose 20.

Bottom wall 12*f* contains drain 14. Drain 14 is connected to drain hose 20, and drains cabinet 12. Cabinet 12, which is sealed against the escape of water, is provided with a door 22 through which clothing to be processed can be inserted. In the preferred embodiment door 22 is transparent, and the garments may be viewed during the operating cycle. Alternatively, door 22 may be opaque and insulated. Door 22 is attached to cabinet 12 with one or more conventional hinges 6. Door 22 is closed and watertight during operation of the device. Door 22 may, but does not have to, extend the entire length of the front wall 12*a* of cabinet 12.

Cabinet 12 is adjacent to sub-cabinet 24. Sub-cabinet 24 contains the mechanism by means of which the operating cycle of apparatus 10 is automatically carried out. The operating cycle may include any variation or combination of pre-washing, washing, rinsing and drying. For means of illustration only, and not as a limitation, the device control mechanism could allow the consumer to set the device for heavy or light washing; set the water temperature; add bleach, fabric softeners, or other laundry additives; set one or more rinse cycles; set a initial delay of the start of the washing cycle to allow for the action of spot-removers; set a delay of the start of the washing cycle to accommodate the convenience of the user; set a pre-wash cycle; and set varying drying temperatures and times. The various washing and drying requirements are set via control panel 28. The electricity for running control panel 28, and all other parts of the device, is supplied through conductor 18.

The device requires the use of a control panel 28 to effectuate the different washing and drying needs of the user. Said control panel 28 includes a timer, a means for setting or programming the various washing and drying cycles, a means for dispensing laundry detergent, bleach, fabric softener, or other laundry additives, and a means for regulating the washing, rinsing, and dying times.

The clothes-receiving portion of cabinet 12 has, at its upper end, a hanging bar 30. Hanging bar 30 is suspended horizontally and parallel to walls 12*a* and 12*b*. Hanging bar 30 has one or more hanger spacers 32. Clothes, towels, sheets or other items to be laundered are placed on a conventional, non-rusting, hanger. The hanger is inserted onto hanging bar 30, and held at regularly spaced intervals by hanger spacers 32.

Manifold 40 is comprised of a plurality of arms 42. The arms 42 are in a single plane, and are parallel to each other, and perpendicular to hanging bar 30. The arms 42 extend on each side of the hanger-mounted garments 26. The first arm in the parallel plane is 42*a*, and the last arm in the parallel plane is 42*z*. The arms 42 are configured such that a hanger-mounted garment 26 may be disposed between and proximate to a pair of the arms 42. For example, a pair of the arms 42 are arms 42*a* and 42*b*.

Figure 2:
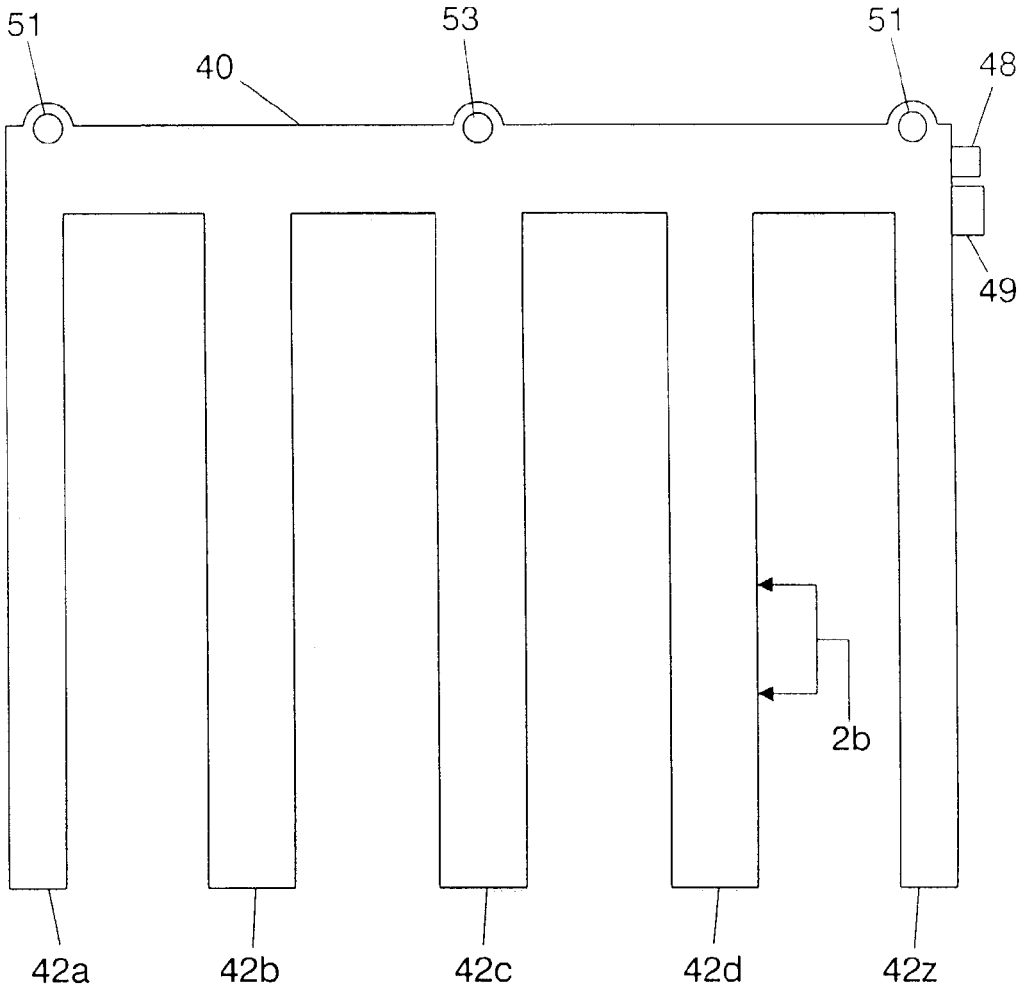
FIG. 2 is a plan view of the manifold.
Figure 2A:
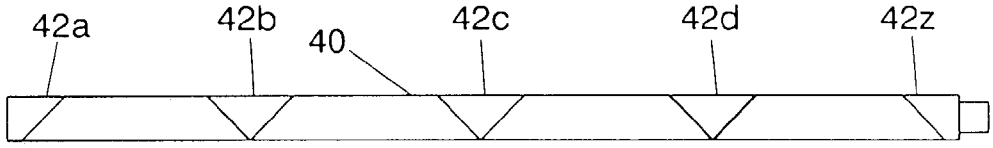
FIG. 2*a* is front elevation view of the manifold.
Figure 2B:
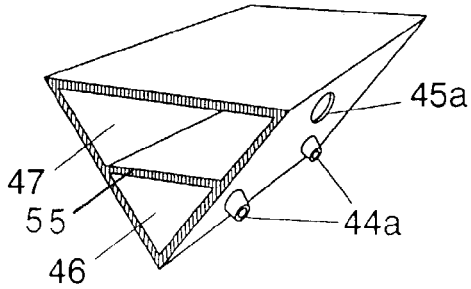
FIG. 2*b* shows a partial sectional view of the area indicated in FIG. 2.

Inside manifold 40 are two sets of internal pipes. One set is the liquid-carrying pipes 46. The other set is the air-carrying pipes 47. The liquid-carrying pipes 46 and air-carrying pipes 47 may be a separate set of internal pipes inside manifold 40. Alternatively, as shown in FIG. 2*b*, the manifold 40, liquid-carrying pipes 46, and air-carrying pipes 47 may be manufactured as a single unit with a divider 55 separating the air in the air-carrying pipes 47 from the water in the water-carrying pipes 46.

Figure 3:
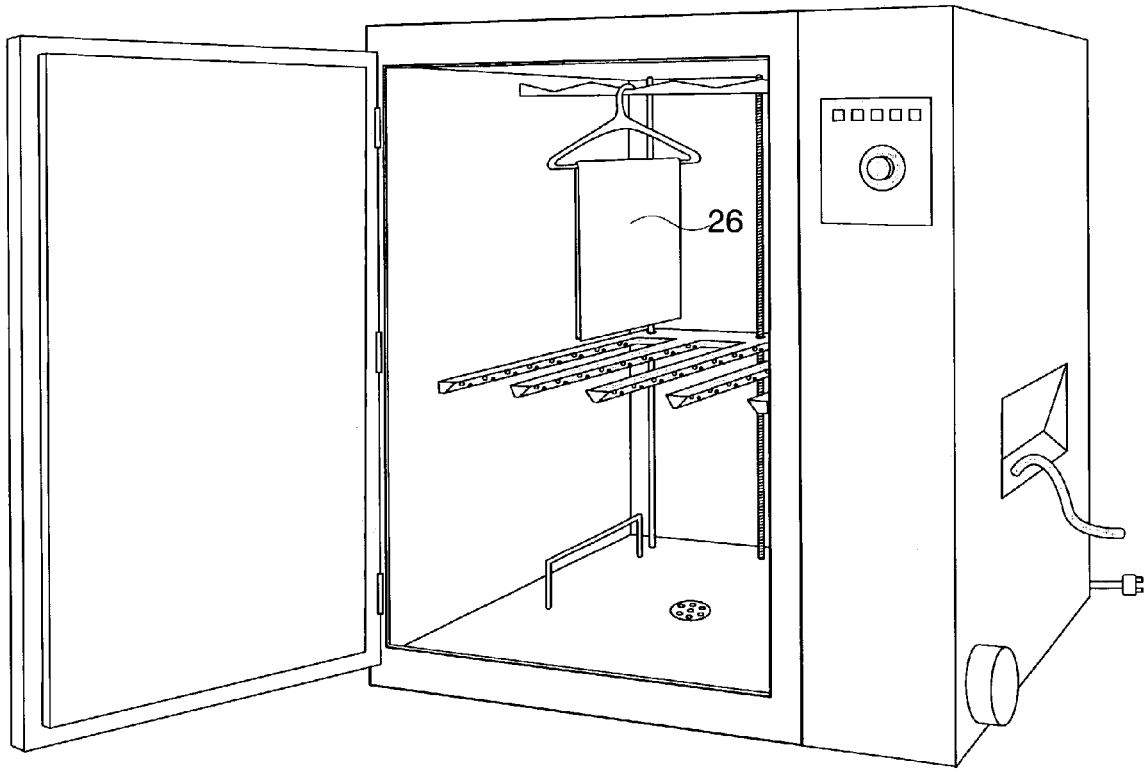
FIG. 3 is a perspective view without a cut-away.

Water enters sub-cabinet 24 through water supply hose 16. Laundry detergent or other laundry additives may be added to the water, as requested by the user. For example, and for purposes of illustration and not limitation, laundry detergent may be added to the water. The water/detergent mixture then travels into manifold 40 and arms 42 through liquid-supply hose 48. Once inside manifold 40, the water/detergent mixture travels through liquid-carrying pipes 46. The water/detergent mixture exits arms 42 through liquid-exits 44. The liquid-exits 44 are configured such that individual hanger-mounted garments 26 disposed adjacent thereto may be spayed on both sides with the water/detergent mixture. The liquid-exits 44 may be either nozzles or holes. The inventor currently prefers to use nozzles for the liquid-exits 44. Manifold 40 moves up and down the length of the hanger-mounted garments 26 spraying both sides of garments 26 with the water/detergent mixture. For example, as illustrated in FIG. 3, the manifold 40 may be vertically positioned to receive a hanger-mounted garment 26 between two adjacent arms 42. The liquid-exits 44 of the two adjacent arms 42 facing the hanger-mounted garment 26 may be used to spray both sides of the hanger-mounted garment 26 at a close range. The water/detergent mixture will run off the garments 26, down to bottom wall 12*f*, through drain 14, and out drain hose 20. In the preferred embodiment bottom wall 12*f* will be sloped in such a manner that drain 14 is at the lowest point in bottom wall 12*f*, causing the water to run out drain 14, and through drain hose 20.

The drying cycle may be started after completion of the washing cycle. In the drying cycle warm or cool air is forced from subcabinet 24 to manifold 40 via air-supply hose 49, and then into manifold 40. Once inside manifold 40, the air travels through air-carrying pipes 47 and out air-exits 45. Air-exits 45 may be either nozzles or holes. The inventor currently prefers to use holes for air-exits 45. Manifold 40 again moves up and down the length of hanger-mounted garments 26 blowing air on both sides of garments 26, and thereby drying the garments 26.

In the preferred embodiment, each arm 42 has a plurality of liquid-exits 44 and air-exits 45. Arm 42*a* has a plurality of exits 44*a* and 45*a* on only the side facing toward garment 26, and arm 42*z* has a plurality of exits 44*z* and 45*z* on only the side facing toward garment 26. The remainder of arms 42 have a plurality of exits 44 and 45 on both sides of each arm 42 so that hanger-mounted garments 26 may be sprayed from both sides.

Liquid-exits 44 and air-exits 45 are placed on arms 42 so that the liquid or air exits arms 42 in a downward direction. The shape of the arms may be any shape that allows the liquid- and air-exits to point downward. The inventor currently prefers to have the cross-sectional shape of the arms be an isosceles triangle with the two equal sides of the triangle facing downward, and to place the liquid- and air-exits on the two downward facing sides of the triangle. The downward angle of the liquid or air may be any angle necessary to prevent garments 26 from tangling and twisting, and to help smooth garments 26. The inventor currently prefers to use a downward angle of between 40 degrees and 60 degrees on liquid-exits 44 and air-exits 45.

There are no specific requirements regarding placement of liquid-exits 44 and air-exits 45 relative to each other. That is, liquid-exits 44 and air-exits 45 may be placed in a horizontal line, may be placed with either on top of the other, or may be placed in any arrangement that allows liquid to exits the liquid-exits 44, and allows air to exit air-exits 45.

Manifold 40 has one or more unthreaded guide holes 51. Apparatus 10 contains one or more guide post 50. In the preferred embodiment, the number of unthreaded guide holes 51 is equal to the number to guide posts 50. Guide post 50 is a smooth post that runs in a vertical direction parallel to rear wall 12*b*. Guide post 50 is inserted through unthreaded hole 51 in manifold 40, and manifold 40 may freely move along the length of guide post 50.

Manifold 40 has one or more threaded screw holes 53. Apparatus 10 contains one or more screw posts 52. In the preferred embodiment, the number of threaded screw holes 53 is equal to the number of screw posts 52. Screw post 52 is a threaded post runs in a vertical direction parallel to rear wall 12*b*. Screw post 52 and threaded screw hole 53 are threaded so that the threaded screw post 52 will turn inside threaded screw hole 53 and, in turning, move manifold 40 either up or down.

Screw post 52 is moveably attached to motor 54. Motor 54 will turn screw post 52 in an alternating clockwise and counter-clockwise direction, thereby moving manifold 40 up and down screw post 52. Motor 54 may be programmed via control panel 28 so that screw post 54 turns in one direction for varying lengths of time. The length of time that screw post 54 turns in any one direction is directly correlated to the length that the manifold travels in any one direction. Thus, screw post 54 may turn for such a length of time that manifold 40 travels only part of the height of cabinet 12, or the entire length of cabinet 12. Control panel 28 may also provide a means for setting or programming the speed of the upward/downward motion, as well as the distance manifold 40 travels in the upward/downward plane.

Manifold 40 will continue to spray garments 26 for the length of time as set by the user. After the wash cycle is completed, the rinse cycle will begin. In the rinse cycle, water alone travels through liquid-supply hose 48 to manifold 40 and into arms 42 through liquid-supplying pipes 46. The water exits arms 42 through liquid-exits 44, and sprays the garments 26 with rinse water. The rinse water exits the device through drain 14 and drain hose 20.

The drying cycle will begin at the time requested by the user after the rinse cycle is complete. The inventor currently prefers to allow a length of time for passive dripping of water from the clothes before beginning the drying cycle. However, the drying cycle may be set to begin at any time, even immediately after completion of the rinse cycle. Ambient air will be drawn into sub-cabinet 24 through air-intake hose 61. If requested by the user, the air will be heated. The air will travel through air-supply hose 49 to manifold 40 and then into arms 42 through air-carrying pipes 48. The air exits through air-exits 45. Manifold 40 moves up and down the length of the garments 26 spraying air onto the garments. The heated air may exit cabinet 12 passively through vent 60. Alternatively, the heated air may be removed from cabinet 12 and processed through condenser 62, removing the moisture from the air. The treated air will then be returned to recirculate in cabinet 12

In the preferred embodiment the apparatus will indicate the end of the washing and drying cycle by a light or suitable alarm.

Although not required, in the preferred embodiment one or more racks 70 may be attached to bottom wall 12*f*. The rack 70 extends horizontally near the bottom of the cabinet 12. Socks or other small items may be placed on the rack 70 and treated as described above.

I claim:

1. A method of cleaning garments, comprising:

supporting one or more garments in a stationary position in an enclosure;

spraying both sides of at least one of the garments in the enclosure from a manifold; and translating the manifold vertically to traverse the vertical length of the garments at least one time during a wash cycle.

2. The method of claim 1 further comprising drying each of the garments in the enclosure from the manifold while vertically translating the manifold to traverse the vertical length of the at least one garment at least one more time during a dry cycle.

3. A garment cleaning apparatus, comprising:

a manifold having a plurality of arms, each of the arms being configured to discharge a fluid; and a cabinet configured to enclose the plurality of arms, the cabinet capable of providing stationary support for one or more garments suspended therein;

wherein at least some of the plurality of arms form at least one pair of adjacent arms, the at least one pair of adjacent arms being configured to receive a stationary garment suspended vertically therebetween, the one or more pairs of adjacent arms being configured to extend horizontally across the stationary garment suspended therebetween to allow the fluid to be simultaneously discharged toward both sides of the garment disposed proximate thereto, wherein the manifold is further configured to traverse, by vertical translation, the length of the garment at least one time while discharging the fluid during a wash cycle.

4. The garment cleaning apparatus of claim 3 wherein each of the pairs of adjacent arms are configured to discharge the fluid in a downward direction toward the garment suspended therebetween.

5. The garment cleaning apparatus of claim 3 wherein the fluid discharged by each of the arms comprises wash water with a cleaning agent during a first portion of a wash cycle and rinse water during a second portion of the wash cycle.

6. The garment cleaning apparatus of claim 5 wherein the rinse water includes a conditioning agent.

7. The garment cleaning apparatus of claim 5 wherein each of the arms are further configured to discharge air during a dry cycle.

8. The garment cleaning apparatus of claim 7 wherein the manifold is further configured to traverse the length of the garments at least one time while discharging the wash water during the first portion of the wash cycle, traverse the length of the garments at least one more time while discharging rinse water during the second portion of the wash cycle, and traverse the length of the garments at least one more time while discharging the air during the dry cycle.

9. The garment cleaning apparatus of claim 7 wherein the manifold is further configured to traverse the length of the garments at least one time while discharging the water during the wash cycle, and traverse the length of the garments at least one more time while discharging the air during the dry cycle.

10. The garment cleaning apparatus of claim 3 wherein each of the arms are further configured to discharge air during a dry cycle.

11. A garment cleaning apparatus, comprising:

a fluid source;

a manifold coupled to the fluid source, the manifold having a plurality of horizontal arms, each of the arms having a plurality of exits; and a cabinet having a stationary hanging bar from which one or more garments may be vertically supported; at least two adjacent arms of the plurality of horizontal arms forming a pair of arms, the pair of arms configured to receive one of the garments vertically disposed therebetween, the pair of arms being configured to spray both sides of the one garment with the fluid through one or more of the exits disposed adjacent the one garment wherein the manifold is movable by translation in the vertical direction.

12. The garment cleaning apparatus of claim 11, wherein the plurality of exits are positioned to direct the fluid at a downward angle of between 40 and 60 degrees relative a horizontal plane of the manifold to generate a downward angular force simultaneously on both sides of the garment being cleaned to assist in stabilizing the garment.

13. The garment cleaning apparatus of claim 11 wherein the fluid source comprises a hose.

14. The garment cleaning apparatus of claim 11 wherein the fluid source is configured to provide wash water with a washing agent during a first cycle and rinse water during a second cycle.

15. The garment cleaning apparatus of claim 14 wherein the rinse water includes a conditioning agent.

16. The garment cleaning apparatus of claim 11 further comprising an air source, and wherein a first portion of the exits in each of the arms is coupled to the fluid source and a second portion of the exits in each of the arms is coupled to the air source.

17. The garment cleaning apparatus of claim 16 wherein each of the arms comprises a first pipe coupling the fluid source to the first portion of the exits, and a second pipe coupling the air source to the second portion of the exits.

18. The garment cleaning apparatus of claim 16 wherein the first portion of the exits each comprises nozzles, and the second portion of the exits each comprises holes.

19. The garment cleaning apparatus of claim 11 wherein at least one of the horizontal arms comprises two sides forming a V-shape, the exits being disposed on the two sides and positioned such that the fluid exits in a downward direction relative the sides of the one garment being cleaned.

20. A garment cleaning apparatus, comprising:

means for providing stationary support for one or more garments in a cabinet; and means for spraying at least one of the garments in the cabinet on both sides using a manifold that traverses by vertical translation of the manifold, the vertical length of the garments at least one time during a wash cycle.

21. The garment cleaning apparatus of claim 20 further comprising means for drying each of the garments in the cabinet from the manifold while the manifold traverses the length of the garments at least one more time during a dry cycle.

* * * * *